US010457361B2

(12) United States Patent
Haynes et al.

(10) Patent No.: US 10,457,361 B2
(45) Date of Patent: Oct. 29, 2019

(54) SELF-RIGHTING LIFE RAFT

(71) Applicant: GOODRICH CORPORATION, Charlotte, NC (US)

(72) Inventors: Timothy C. Haynes, Prescott Valley, AZ (US); Michael A. Luzader, Laveen, AZ (US)

(73) Assignee: GOODRICH CORPORATION, Charlotte, NC (US)

( * ) Notice: Subject to any disclaimer, the term of this patent is extended or adjusted under 35 U.S.C. 154(b) by 0 days.

(21) Appl. No.: 15/893,002

(22) Filed: Feb. 9, 2018

(65) Prior Publication Data

US 2019/0248456 A1 Aug. 15, 2019

(51) Int. Cl.
*B63C 9/04* (2006.01)

(52) U.S. Cl.
CPC ..... *B63C 9/04* (2013.01); *B63C 2009/042* (2013.01); *B63C 2009/046* (2013.01)

(58) Field of Classification Search
CPC ..... B63C 9/04
See application file for complete search history.

(56) References Cited

U.S. PATENT DOCUMENTS 3,883,913 A * 5/1975 Givens ..... B63C 9/06 441/37
4,998,900 A * 3/1991 Wright ..... B63C 9/04 114/349
5,579,609 A * 12/1996 Sallee ..... B64G 9/00 156/156
5,733,158 A * 3/1998 Higginbotham ..... B63C 9/06 441/38
5,800,225 A * 9/1998 Shoaff, III ..... B63C 9/02 114/39.14

FOREIGN PATENT DOCUMENTS

GB 673417 6/1954
WO 2005017291 2/2005

* cited by examiner

*Primary Examiner* — Stephen P Avila
(74) *Attorney, Agent, or Firm* — Snell & Wilmer L.L.P.

(57) ABSTRACT

A life raft includes a base and an inflatable canopy. The base has a first side and a second side and the inflatable canopy is coupled to the first side of the base and configured to inflate and extend across the first side of the base to form a first chamber defined between the first side of the base and the inflatable canopy. The inflatable canopy is configured to inflate in response to deploying the life raft. Inflation of the inflatable canopy enables the life raft to self-right. In various embodiments, the base includes an inflatable border tube defining a first inflatable volume. The inflatable canopy may define a second inflatable volume and the first inflatable volume may be in fluidic communication with the second inflatable volume.

18 Claims, 4 Drawing Sheets

SELF-RIGHTING LIFE RAFT

FIELD

The present disclosure relates to aircraft evacuation assemblies, and more specifically to a self-righting life raft.

BACKGROUND

In the event of an emergency water landing, aircraft typically have one or more life rafts that can be deployed to hold evacuated passengers. Conventional non-reversible rafts may be either deployed in a specific orientation to prevent inflation in an inverted position or may be able to be manually righted after an inverted deployment. While certain conventional life rafts are reversible, meaning they can be deployed and utilized to support evacuated passengers on either side of the life raft, these reversible life rafts often utilize orientation sensing technology and/or they have redundant features, which may add to the complexity and cost of the life raft.

SUMMARY

According to various embodiments, the present disclosure provides a life raft that includes a base and an inflatable canopy. The base has a first side and a second side and the inflatable canopy is coupled to the first side of the base and configured to inflate and extend across the first side of the base to form a first chamber defined between the first side of the base and the inflatable canopy, according to various embodiments. The inflatable canopy is configured to inflate in response to deploying the life raft, in accordance with various embodiments.

In various embodiments, the base includes an inflatable border tube defining a first inflatable volume. The inflatable canopy may define a second inflatable volume and the first inflatable volume may be in fluidic communication with the second inflatable volume. In various embodiments, a user access opening is defined between the inflatable border tube and the inflatable canopy. A charge cylinder may be coupled to the inflatable border tube, and the charge cylinder may be positioned offset from the user access opening.

In various embodiments, the inflatable canopy is coupled along and extends from at least 50% of a circumference of the base. In various embodiments, the base has a diameter and the inflatable canopy spans a height in an inflated state, with the height measured between the first side of the base and the inflatable canopy. The height may be substantially equal to the diameter, or the height may be greater than the diameter. In various embodiments, the internal volume of the inflatable canopy in an inflated state is about 10,000 cubic inches. In various embodiments, the inflatable canopy has a dimpled dome shape.

Also disclosed herein, according to various embodiments, is a method of using a life raft. The method may include initializing inflation of the life raft and deploying the life raft in water to self-right life raft. In various embodiments, the life raft self-rights in response to inflation of an inflatable canopy coupled to a first side of a base of the life raft.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
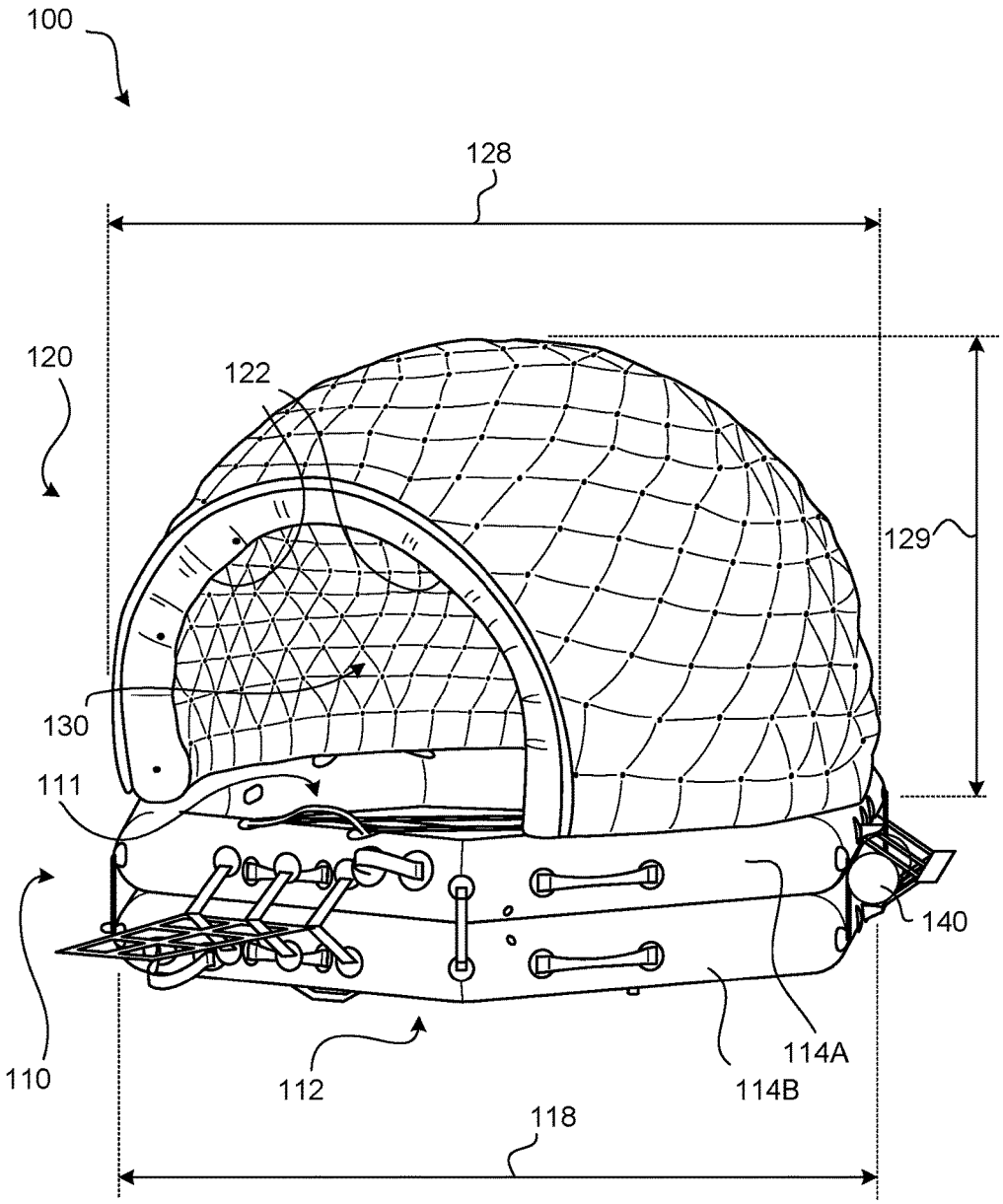
FIG. 1 is a perspective view of a life raft with an inflatable canopy in an inflated state, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation. Throughout the present disclosure, like reference numbers denote like elements. Accordingly, elements with like element numbering may be shown in the figures but may not be necessarily be repeated herein for the sake of clarity.

In the event of an emergency water landing, aircraft typically have one or more life rafts that can be deployed to hold evacuated passengers. In various embodiments, and with reference to FIG. 1, the present disclosure provides a life raft 100 that includes an inflatable canopy 120 that tends to facilitate self-righting of the life raft 100. That is, in various embodiments, the inflatable canopy 120 may protect passengers from the sun, rain, weather conditions, and other elements, as well as tend to enable the life raft 100 to self-right regardless of its original deployment orientation, as described in greater detail below. Accordingly, the self-righting life raft 100 may be utilized and deployed without the use of orientation sensing valves and other such features for reversible life rafts, thereby decreasing the complexity of the life raft, decreasing the weight of the life raft, and decreasing the cost of the life raft, according to various embodiments.

In various embodiments, and with reference to FIG. 1, life raft 100 generally includes a base 110 and the inflatable canopy 120. The base has a first side 111 and a second side 112 opposite the first side 111. The inflatable canopy 120 is coupled to the first side 111 of the base 110 and is configured to inflate and extend across the first side 111 of the base 110 to form a first chamber 130 defined between the first side 111 of the base 110 and the inflatable canopy 120, according to various embodiments. The inflatable canopy 120 may be automatically inflated in response to deploying the life raft 100.

In various embodiments, the first side 111 of the base 110 of the life raft 100 is a top surface of the life raft 100 upon which passengers are supported in response to the life raft 100 being deployed in water. That is, the base 110 of the life raft 100 may be inflatable, and the base 110 may include one or more inflatable border tubes 114A, 114B. The first and second inflatable border tubes 114A, 114B may provide buoyancy to the life raft 100 and may be mounted one above the other. The first and second inflatable border tubes 114A, 114B may provide a degree of buoyancy redundancy in that each border tube may be independently capable of supporting the weight of the life raft 100 when filled to capacity with passengers. The first inflatable border tube 114A may circumscribe the first side 111 of the base 110 and the second inflatable border tube 114B may circumscribe the second side 112 of the base 110. The base 110 of the life raft 100 may include one or more ladders, handles, etc., that facilitate passengers embarking. The second side 112 of the base 110 of the life raft 100 may be a bottom surface of the life raft 100 that faces the water.

Figure 2:
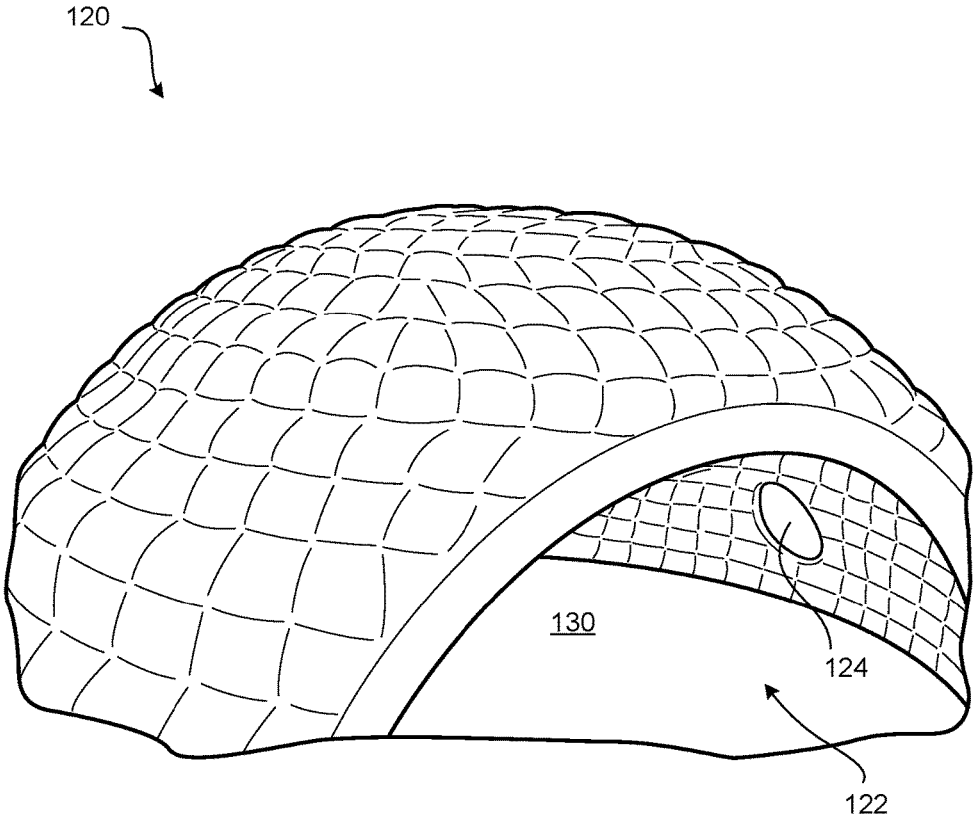
FIG. 2 is a perspective view of an inflatable canopy of a life raft, in accordance with various embodiments.

In various embodiments, and with reference to FIGS. 1 and 2, the inflatable canopy 120 functions as a protective covering that shields passengers from sun, rain, wind, other weather conditions, and/or other elements. The inflatable canopy 120 also enables the life raft 100 to self-right, as described in greater detail below. In various embodiments, the inflatable canopy 120 structurally supports itself, and thus the life raft 100 may not include a supporting arch structure. Additionally, the life raft 100 does not include an orientation sensing valve, according to various embodiments. In various embodiments, the inflatable canopy 120 has a dome shape. The dome shape may facilitate the self-righting response of the life raft 100. In various embodiments, the inflatable canopy 120 has an inner layer and an outer layer, with various internal structural ties extending through the internal volume of the inflatable canopy 120 to hold the outer layer and the inner layer together. In various embodiments, the inflatable canopy 120 has a dimpled dome shape, with the dimples resulting from the internal structural ties. The inflatable canopy 120 may be made from a fabric material, a plastic material, or a composite material, among others. For example, the inflatable canopy 120 may be made from nylon or a nylon material coated with a thermoplastic material, among others.

In various embodiments, and with continued reference to FIGS. 1 and 2, the inflatable border tube 114A of the base 110 defines a first inflatable volume and the inflatable canopy 120 defines a second inflatable volume. In various embodiments, the life raft 100 may include a charge cylinder 140 coupled to the one or more inflatable border tubes 114A, 114B, and the charge cylinder 140 may be configured to deliver air and/or other fluid into the one or more inflatable border tubes 114A, 114B and into the inflatable canopy 120. For example, the first inflatable volume of the inflatable border tube 114A may be in fluidic communication with the second inflatable volume of the inflatable canopy 120, and thus air/fluid delivered to the inflatable border tube 114A may flow from the first inflatable volume into the second inflatable volume of the inflatable canopy 120. In various embodiments, a user access opening 122 is defined between the inflatable border tube 114A and the inflatable canopy 120. The life raft 100 may include one or more user access openings 122, and/or the life raft 100 may include one or more window openings 124 (see FIG. 2).

Figures 3A, 3B, 3C, 3D:
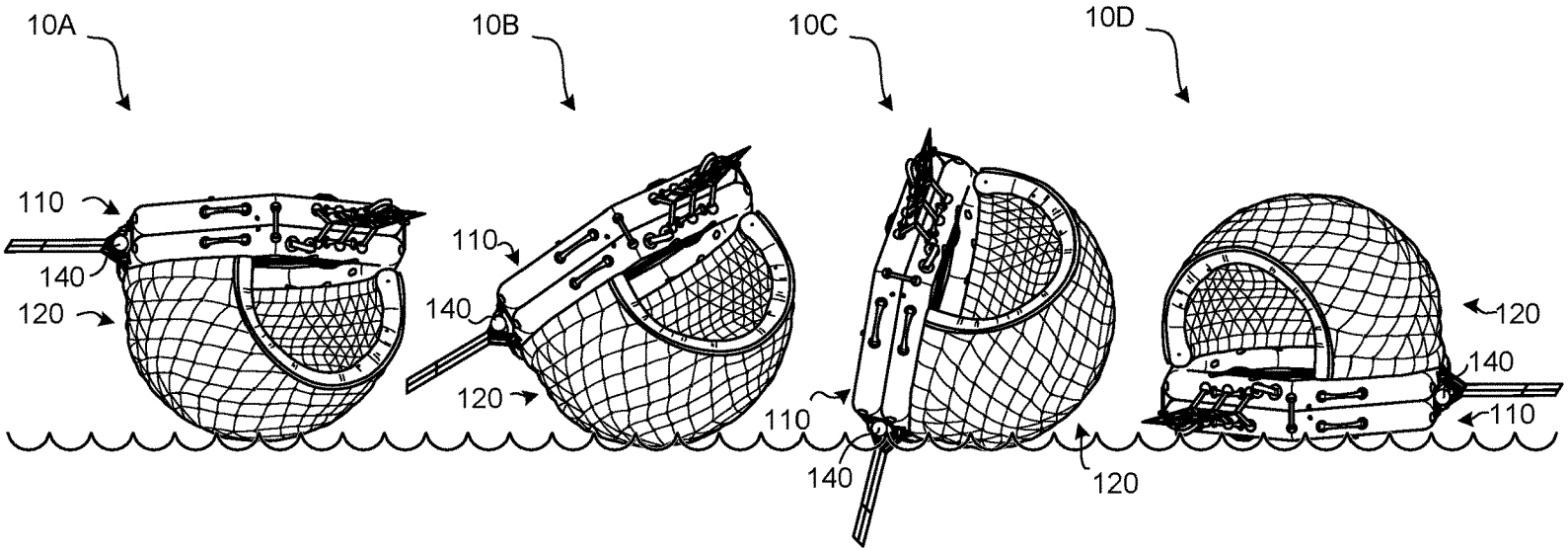
FIGS. 3A, 3B, 3C, and 3D are perspective views of progressive stages of a life raft self-righting from an inverted position to a righted position, in accordance with various embodiments.

In various embodiments, and with reference to FIGS. 3A, 3B, 3C, and 3D, the inflatable canopy 120 of the life raft 100 facilitates and/or enables the life raft 100 to self-right. Accordingly, FIGS. 3A, 3B, 3C and 3D show the life raft 100 automatically transitioning from an inverted position 10A, with the base 110 generally situated above inflatable canopy 120, to a righted position 10D, with the base 110 below the inflatable canopy 120, in response to being deployed. That is, FIGS. 3A-3D show the life raft 100 automatically self-righting in response to being deployed into the water. While the life raft 100 is shown in each of FIGS. 3A-3D as being fully inflated, during an actual deployment of the life raft 100, the life raft 100 would begin to self-right as the inflation progresses. Accordingly, if the life raft 100 were initially deployed into the water in the inverted position 10A, as the base 110 and the inflatable canopy 120, the increasing buoyancy of the inflatable canopy 120 as it inflates may cause the life raft 100 to transition (e.g., roll) into the first semi-inverted position 10B (FIG. 3B), according to various embodiments. As the inflation progresses and as more air is delivered to the inflatable canopy 120, the life raft 100 continues to transition and/or roll into the second semi-inverted position 10C (FIG. 3C), according to various embodiments. As the inflation of the inflatable canopy progresses further towards fully inflated, the life raft 100 may transition to the righted position 10D (FIG. 3D).

In various embodiments, various features of the life raft 100 may contribute to the self-righting ability of the life raft 100. For example, the inflatable canopy 120 may be coupled along and may extend from at least 50% of a circumference of the base 110. That is, from the perspective a passenger sifting in the center of the life raft 100, at least 180 degrees of the passenger's view is obstructed by the inflatable canopy 120. In various embodiments, the inflatable canopy 120 is coupled along and extends from at least 70% of the circumference of the base 110. This extent of coverage of the inflatable canopy 120 over the base 110 helps to enable the self-righting performance of the life raft 100, according to various embodiments.

In various embodiments, and with renewed reference to FIG. 1, the base 110 has a diameter 118, which is generally defined as the width or horizontal length of the base 110 of the life raft 100 in an inflated state. The base 110 may have a generally circular shape, an oval shape, a polygonal shape, etc., and thus the diameter 118 is generally defined as the longest diameter across the base 110 of the life raft 100. The inflatable canopy 120 spans a height 129 in the inflated state, as generally defined as the vertical length of the inflatable canopy 120 from its attachment point at the base 110 to the top most portion of the inflatable canopy 120, according to various embodiments. In various embodiments, the height 129 of the inflatable canopy 120 is substantially equal to the diameter 118 of the base 110. In various embodiments, the height 129 is greater than the diameter 118. In various embodiments, the inflatable canopy 120 has a dimension 128 parallel to the diameter 118 that is greater than the diameter 118. That is, the outermost perimeter/circumference of the inflatable canopy 120 at its widest point may be larger than the corresponding outermost perimeter/circumference of the base 110. For example, when viewing the life raft 100 from a top plan view, the footprint of the of the outermost perimeter/circumference of the inflatable canopy 120 at its widest point may generally circumscribe the corresponding footprint of the outermost perimeter/circumference of the base 110. Accordingly, the inflatable canopy 120 may bow radially outwards, relative to a central location within the first chamber 130, from its attachment at the base 110 before bowing back inwards towards the pinnacle/top of the inflatable canopy 120.

The base 110 of the life raft 100, according to various embodiments, may have a diameter 118 of about 50 inches (127 centimeters), with the internal volume of the inflatable canopy being about 10,000 cubic inches (160 liters). As used in this context only, the term "about" refers to plus or minus 5% of the stated value. In various embodiments, the internal volume of the inflatable canopy 120 is between about 50% and about 100% of the internal volume of the base 110.

In various embodiments, the position of the charge cylinder 140 is offset from the location of the user access opening 122. For example, the charge cylinder 140 may be offset about 90 degrees from the user access opening 122. In various embodiments, the charge cylinder 140 is positioned opposite the user access opening 122. In various embodiments, and with reference to FIGS. 3A, 3B, 3C, and 3D, the life raft 100 may tend to roll in the direction of the charge cylinder 140 as it self-rights and progresses through positions 10A-10D. Thus, by offsetting the position of the user access opening 122 relative to the charge cylinder 140, water may be prevented or at least inhibited from entering the first chamber 130 of the life raft 100 during deployment.

Figure 4:
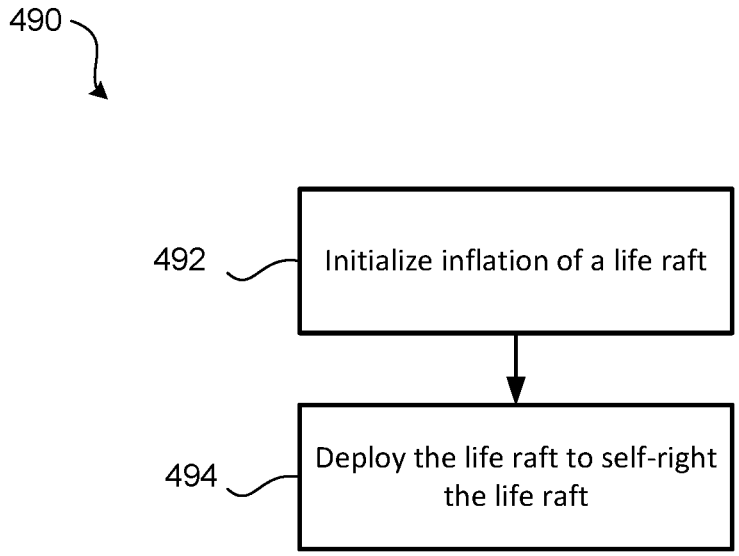
FIG. 4 is a schematic flow chart diagram of a method of using a life raft, in accordance with various embodiments.

In various embodiments, and with reference to FIG. 4 a method 490 of using the life raft 100 is provided. The method 490 may include initializing inflation of the life raft 100 at step 492 and deploying the life raft 100 to self-right the life raft 100 at step 494. That is, the life raft 100 may self-right in response to inflation of the inflatable canopy 120 at step 494. In various embodiments, initializing inflation of the life raft 100 includes releasing fluid flow from the charge cylinder 140 into the first inflatable volume defined by the inflatable border tube 114A and into the second inflatable volume defined the inflatable canopy 120. In various embodiments, the first inflatable volume is in fluidic communication with the second inflatable volume. In various embodiments, the charge cylinder 140 is coupled to the base 110 offset from the user access opening 122 such that during deploying the life raft 100 at step 494, the life raft 100 transitions from the inverted position 10A to the righted position 10D, with water being inhibited from flowing into the first chamber 130 through the user access opening 122.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A life raft comprising:

a base comprising a first side and a second side; and an inflatable canopy coupled to the first side of the base and configured to inflate and extend across the first side of the base to form a first chamber defined between the first side of the base and the inflatable canopy;

wherein the inflatable canopy is configured to inflate in response to deploying the life raft;

wherein the inflatable canopy is coupled along and extends from at least 50% of a circumference of the base;

wherein the inflatable canopy comprises a dome having an inner layer and an outer layer, wherein an internal inflatable volume of the inflatable canopy is defined between the inner layer and the outer layer;

wherein the base comprises an inflatable border tube defining a first inflatable volume;

wherein the internal inflatable volume of the inflatable canopy is a second inflatable volume; and wherein the first inflatable volume is in fluidic communication with the second inflatable volume.

2. The life raft of claim 1, wherein:

the second inflatable volume is between about 50% and about 100% of the first inflatable volume.

3. The life raft of claim 1, wherein the inflatable canopy is coupled along a top side of the inflatable border tube and extends from at least 70% of the circumference of the inflatable border tube.

4. The life raft of claim 1, wherein:

the base comprises a diameter; and the inflatable canopy spans a height in an inflated state;

the height is measured between the first side of the base and the inflatable canopy; and the height is substantially equal to the diameter.

5. The life raft of claim 1, wherein:

the base comprises a diameter; and the inflatable canopy spans a height in an inflated state;

the height is measured between the first side of the base and the inflatable canopy; and the height is greater than the diameter.

6. The life raft of claim 1, wherein:

the inflatable border tube comprises a diameter; and a dimension of the inflatable canopy parallel to the diameter is greater than the diameter.

7. The life raft of claim 1, wherein an internal volume of the inflatable canopy in an inflated state is about 10,000 cubic inches.

8. The life raft of claim 1, wherein the inflatable canopy has a dimpled dome shape.

9. A life raft comprising:

a base comprising an inflatable border tube defining a first inflatable volume, wherein the base comprises a first side and a second side; and an inflatable canopy defining a second inflatable volume wherein the inflatable canopy is coupled to a top side of the inflatable border tube and configured to inflate and extend across the first side of the base to form a first chamber defined between the first side of the base and the inflatable canopy;

wherein the first inflatable volume is in fluidic communication with the second inflatable volume and wherein the inflatable canopy is configured to inflate in response to deploying the life raft;

wherein the inflatable canopy comprises a dome having an inner layer and an outer layer, wherein the second inflatable of the inflatable canopy is defined between the inner layer and the outer layer; and wherein the inflatable canopy initially extends radially outwards, relative to a central location within the first chamber, before bowing back inwards towards a pinnacle of the inflatable canopy.

10. The life raft of claim 9, wherein the inflatable canopy is coupled along the top side of the inflatable border tube and extends from at least 50% of a circumference of the inflatable border tube.

11. The life raft of claim 10, wherein:

the base comprises a diameter; and the inflatable canopy spans a height in an inflated state;

the height is measured between the first side of the base and the inflatable canopy; and the height is substantially equal to the diameter.

12. The life raft of claim 10, wherein:

the base comprises a diameter; and the inflatable canopy spans a height in an inflated state;

the height is measured between the first side of the base and the inflatable canopy; and the height is greater than the diameter.

13. The life raft of claim 10, wherein:

the inflatable border tube comprises a diameter; and a dimension of the inflatable canopy parallel to the diameter is greater than the diameter.

14. The life raft of claim 13, wherein an internal volume of the inflatable canopy in the inflated state is about 10,000 cubic inches.

15. A method of using a life raft, the method comprising:

initializing inflation of the life raft; and deploying the life raft in water, wherein the life raft self-rights in response to inflation of an inflatable canopy coupled to a first side of a base of the life raft;

wherein:

the inflatable canopy comprises a dome having an inner layer and an outer layer;

the inflatable canopy defines an internal inflatable volume;

the internal inflatable volume of the inflatable canopy is defined between the inner layer and the outer layer;

the base comprises a diameter when fully inflated; and a dimension of the inflatable canopy, when the inflatable canopy is fully inflated and parallel to the diameter, is greater than the diameter.

16. The method of claim 15, wherein the base comprises an inflatable border tube, wherein the initializing inflation of the life raft comprises releasing fluid flow from a charge cylinder coupled to the life raft to flow into a first inflatable volume defined by the inflatable border tube and into the internal inflatable volume defined by the inflatable canopy.

17. The method of claim 16, wherein the first inflatable volume is in fluidic communication with the internal inflatable volume.

18. The method of claim 16, wherein a user access opening is defined between the inflatable border tube and the inflatable canopy, wherein the charge cylinder is coupled to the base offset from the user access opening, wherein during deploying the life raft in the water to self-right the life raft the life raft transitions between an inverted position and a righted position, wherein during the transition the water is inhibited from flowing into a first chamber defined between the first side of the base and the inflatable canopy.

* * * * *